US005701939A

United States Patent [19]

Pinto et al.

[11] Patent Number: 5,701,939

[45] Date of Patent: Dec. 30, 1997

[54] SUN BLOCKING SHADE DEVICE

[76] Inventors: Michal Pinto; Akiva Pinto, both of 516 Eastwood Dr., Gastonia, N.C. 28054-4911

[21] Appl. No.: 575,959

[22] Filed: Dec. 21, 1995

[51] Int. Cl.[6] ..... A47H 5/00

[52] U.S. Cl. ..... 160/84.01; 160/84.05; 160/130; 160/178.1 R; 160/178.3 R

[58] Field of Search ..... 160/84.01, 84.02, 160/84.03, 84.04, 84.05, 85.08, 168.1, 178.3 R, 178.1 R, 172 R, 89, 130

[56] References Cited

U.S. PATENT DOCUMENTS

| | | | |
|---|---|---|---|
| 414,743 | 11/1889 | Wilson | 160/178.3 R X |
| 595,146 | 12/1897 | Churchill | 160/178.3 R X |
| 1,937,342 | 11/1933 | Higbie | 160/84.05 X |
| 2,110,145 | 3/1938 | Loehr | 160/168.1 R X |
| 2,722,979 | 3/1955 | Janowitz | 160/130 |
| 2,923,350 | 2/1960 | Brown | 160/172 R |
| 2,990,923 | 7/1961 | Macias-Sarria | 160/89 |
| 4,002,188 | 1/1977 | Hanks | 139/420 R |
| 4,673,600 | 6/1987 | Anderson | 160/84.05 X |
| 4,677,012 | 6/1987 | Anderson | 160/84.05 X |
| 4,677,013 | 6/1987 | Anderson | 160/84.05 X |
| 4,993,187 | 2/1991 | Schweiss et al. | 49/56 |
| 5,165,459 | 11/1992 | Gaber et al. | 160/168.1 |
| 5,205,335 | 4/1993 | Horton et al. | 160/115 |
| 5,274,357 | 12/1993 | Riordan | 160/84.05 X |
| 5,377,737 | 1/1995 | Moriya et al. | 160/84.06 |
| 5,386,867 | 2/1995 | Chen | 160/168.1 |
| 5,390,720 | 2/1995 | Colson et al. | 160/84 |
| 5,558,925 | 9/1996 | Fritzman | 160/84.01 X |

*Primary Examiner*—Blair Johnson
*Assistant Examiner*—Bruce A. Lev
*Attorney, Agent, or Firm*—Cort Flint

[57] ABSTRACT

A covering device is disclosed for substantially blocking solar rays and heat coming inwardly through an architectural opening while allowing substantial visibility outwardly through the covering and opening. The covering includes a plurality of sun blocking cells having inner perimeter walls with a depth which is effective for blocking the sun rays entering at various vertical and horizontal angles. In particular, the sides of the perimeter wall are effective for blocking sun entering at side or horizontal angles. Preferably the cells are made from thin strip material so that the covering has a total open area greater than 80% or more from a front view looking outward. Open areas as high as 95% may be achieved with the invention, while blocking substantial amounts of solar rays and heat.

7 Claims, 4 Drawing Sheets

Fig. 8A
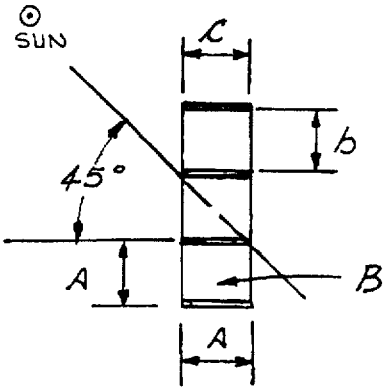
Fig. 9A
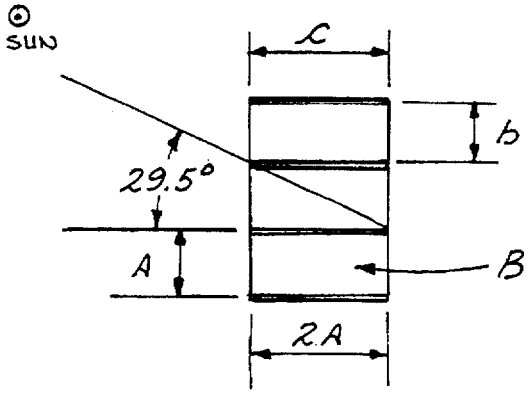
Fig. 8B
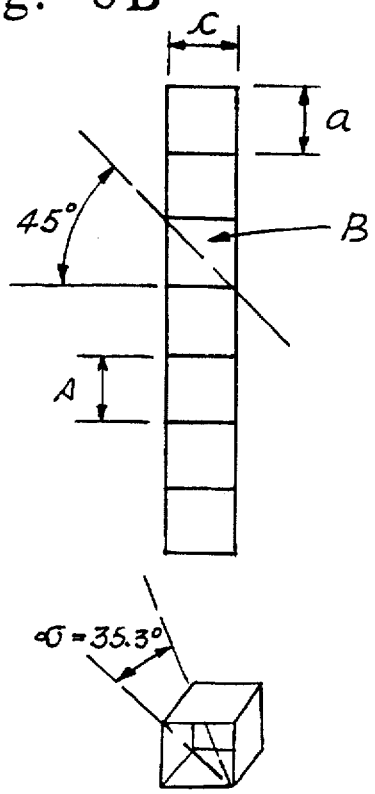
Fig. 9B
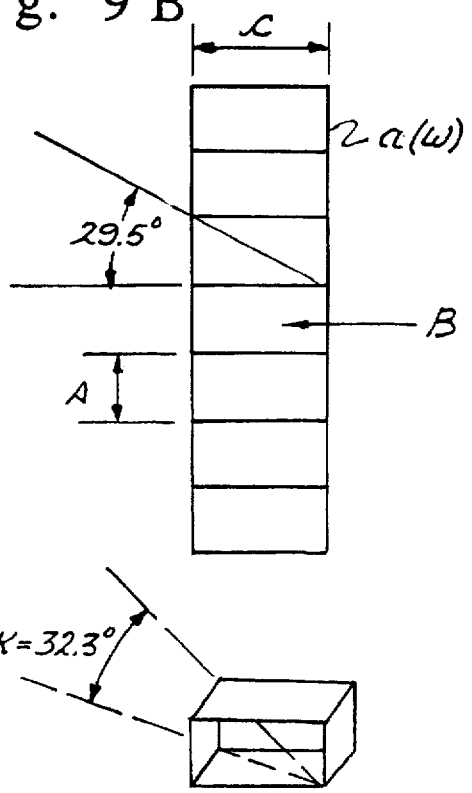
Fig. 8C
Fig. 9C

SUN BLOCKING SHADE DEVICE

BACKGROUND OF THE INVENTION invention is directed to a sun blocking shade, and, more particularly, to a device which blocks a substantial amount of solar rays and heat inwardly through an architectural opening while allowing substantial visibility outwardly through the shade and opening.

In the past, shades, coverings, and other devices have been proposed for windows and doors to control the amount of sunlight and/or visibility. One popular type of covering has been the conventional venetian blind constructed from a plurality of horizontal slats. A tilting device tilts the slats from a level to an inclined configuration to control the amount of light or visibility through the blind. The venetian blind also includes draw cords by which the entire venetian blind may be raised to a collapsed position where the blind is substantially out of the line of sight through the window. U.S. Pat. Nos. 5,205,335 and 5,386,867 disclose conventional venetian blinds and improvements to those blinds. While the venetian blind is popular and suitable for many applications, its ability to block sunlight and rays is somewhat limited. This is due mainly to the design of the venetian blind which is to block the sun rays coming from vertical directions, depending on the angle or orientation of the slats of the blind. The venetian blind is somewhat limited in its ability to block sun rays entering from a diagonal, or from the side or from more or less horizontal angles.

U.S. Pat. No. 4,002,188 proposes a woven shade screen to block the sun to reduce glare and heat, but not to block the view. However, while the product is promoted as blocking up to 70% of the sun's heat and glare, it would appear that the view provided through the screening material is significantly reduced because the open space through the screen is only about 40% of the total area.

U.S. Pat. Nos. 5,390,720 and 5,165,459 are directed to window coverings which are varied from the conventional venetian blind. In the first patent, dead air cells are provided for appearance and insulating properties by causing the slats to pivot about a pivot point until the contiguous slats contact each other to form dead air cells. While the dead air cells may provide desired insulting properties, they also impair the visibility through the covering. The second patent discloses a tubular cell window covering which includes a plurality of contiguous cells which have been bonded together to form a wavy or undulating pattern along the length of the cells which extend horizontally. The covering is made from fabric and is also limited in its ability to block sun rays and/or provide substantial visibility. It has also been known to provide window guards in the form of rectangular grids as security devices as shown in U.S. Pat. No. 4,993,187.

While the above devices are suitable for their intended purposes, it is desirable in some geographical locations, particularly where extremely bright sun occurs during the day, to provide increased blocking of sun rays and heat without impairing the ability to see substantially through the covering or shade. For example, in the Middle East the terrain, arid climate, and other environmental conditions provide for extremely bright sunlight during the day. Typically solid or other non-transparent window coverings which may be removed or rolled out of sight are utilized during the extremely bright portions of the day. Obviously, these devices, while blocking the bright sun, also block the visibility. The blocked visibility not only decreases the enjoyment of outside areas such as gardens and other aesthetically pleasing terrain on the exterior buildings, but produce a very dark and contrasting interior environment.

Accordingly, an object of the invention is to provide an improved covering for an architectural opening which blocks a substantial amount of sun rays and heat yet provides a substantial amount of visibility, and ventilation if desired, at the same time.

Another object of the present invention is to provide a device for covering an architectural opening to block a substantial amount of sun rays and heat yet simultaneously provide a substantial amount of visibility and ventilation, and wherein the device may be easily moved or removed to a non-functioning position.

Yet another object of the invention is to provide a simple device for covering an architectural opening to provide increased sun blocking while providing increased visibility through the device yet which is simple in construction and operation.

SUMMARY OF THE INVENTION

The above objectives are accomplished according to the present invention by providing a device for covering an architectural opening to substantially block solar rays and heat while allowing substantial light to come inward and visibility outward through the opening wherein the device comprises a covering having dimensions generally approximate that of said architectural opening. The covering includes a plurality of sun blocking cells arranged in a two-dimensional array in said covering. The sun blocking cells include an inner perimeter wall having a depth defined between front and rear openings by which said inner walls of the cells effectively block a substantial amount of the solar rays and heat. The sun blocking cells have an open configuration in which a cell passage is defined transverse to the architectural opening providing see through visibility through the opening, and the sun blocking cells having a closed configuration in which the visibility is reduced. In an advantageous embodiment of the invention, the covering is drawable and has an undrawn position in which the covering generally co-extends with the architectural opening and the sun blocking cells are in the open configuration, and the covering has a drawn configuration in which the sun blocking cells are in the closed configuration. In a preferred embodiment of the invention, the sun blocking cells have a height generally equal to the depth of the cells, and the sun blocking cells have a width which is generally equal to or greater than the height and depth of the cells. The depth may be in a range of one-half to twice the cell height or width with effective results. The sun blocking cells preferably have a rectangular cross-section which is generally square with generally equal sides. The covering may be constructed so as to include a plurality of first strip elements spaced along a first dimension of the covering; and a plurality of second strip elements extending between the first strip elements to define the sun blocking cells. One of the first and second strip elements preferably includes foldable web elements so that the sun blocking cells assume a generally closed configuration when the covering is drawn together in a direction corresponding to the first dimension.

The second strip elements may comprise the foldable webs extending between the first strip elements. The strip elements may be thin strip elements having a depth in a direction of a line of sight through the cell passage; and the strip elements collapse or fold to allow the covering to be moved to the drawn configuration.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIGS. 8A–8C are schematic illustrations of a first configuration for sun blocking cells in a sun blocking covering according to the invention; and FIGS. 9A–9C are schematic illustrations of another embodiment of sun blocking cell configurations for a sun blocking shade according to the invention.

DESCRIPTION OF A PREFERRED EMBODIMENT

Figures 1, 2, 2A:
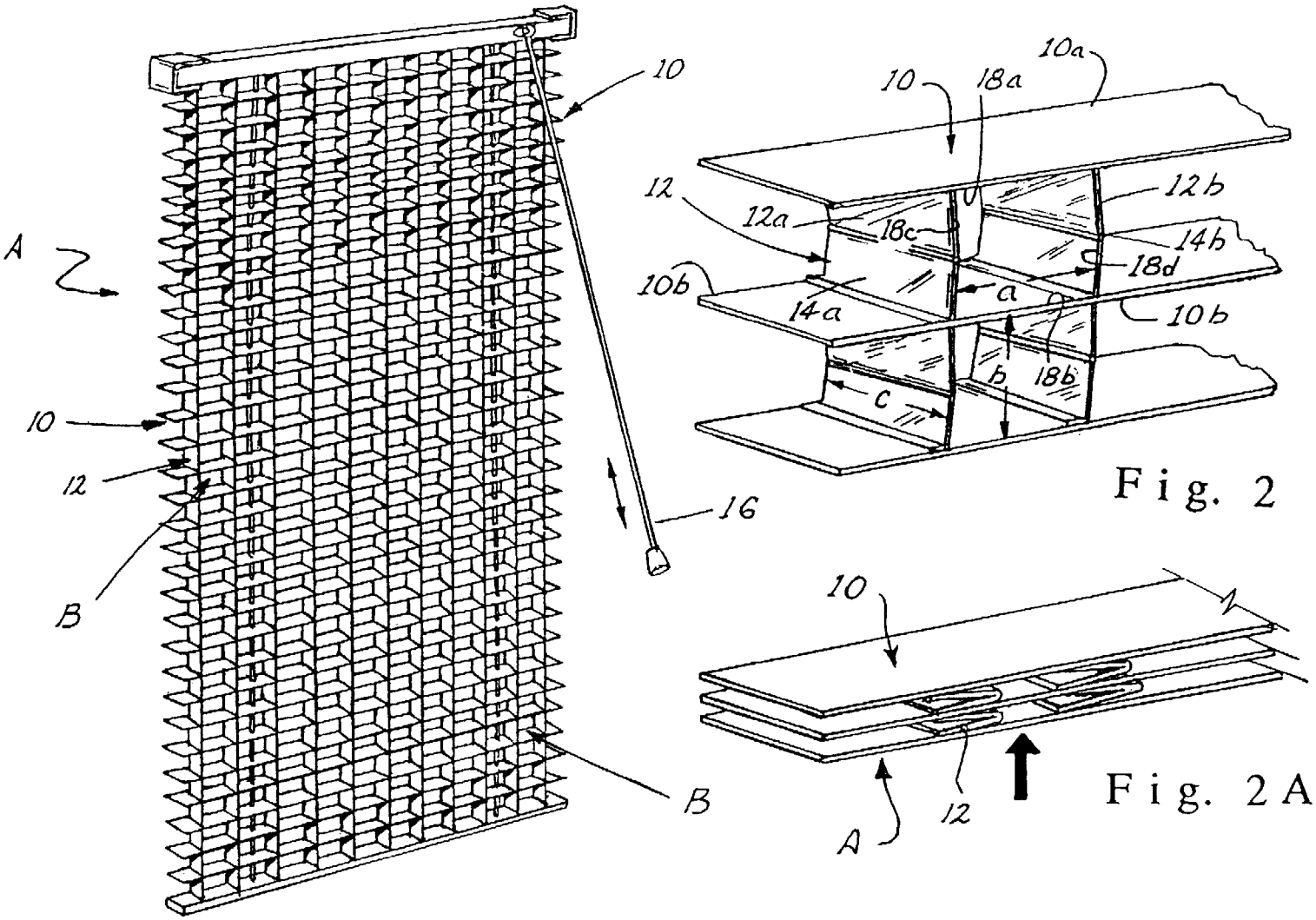
FIG. 1 is a perspective view of a device for covering an architectural opening which provides increased sun blocking and visibility simultaneously.
FIG. 2 is a partial perspective illustrating the configuration of sun blocking cells in a device according to the invention for providing increased sun blocking and visibility.
FIG. 2A is partial perspective view illustrating the device in FIG. 2 in a folded configuration.

Referring now in more detail to the drawings, as can best be seen in FIGS. 1 and 2, a preferred embodiment of a sun blocking covering, designated generally as A is illustrated. The covering may have outer dimensions approximately equal to that of an architectural opening 11 (FIG. 4) over which the covering is placed. Covering A includes a plurality of parallel, first strip elements 10 which may be wood, plastic, fabric, or other suitable material, which are spaced along a first dimension of the covering device. A plurality of second, transverse strip elements 12 are spaced across a second dimension of the covering transverse to the first system of elements 10. Elements 12 may either be a foldable web 14 having a fold line 14*a* extending between elements 10 which are solid, or elements 12 may extend through elements 10. The strip elements may be adhered, bonded, stitched, or otherwise fabricated in the grid or array arrangement illustrated. In any case, the importance is that the strips form a closed-sided sun blocking cell, designated generally as B which provide the major sun blocking over the dimension of the covering A. The covering has an undrawn configuration wherein second strip elements 12 are extended, and the cell are open, as can best be seen in FIG. 2. With the covering drawn, as best can be seen in FIG. 2A, the second strip elements 12 are folded, and the cells are essentially closed and nonfunctional.

Figure 3:
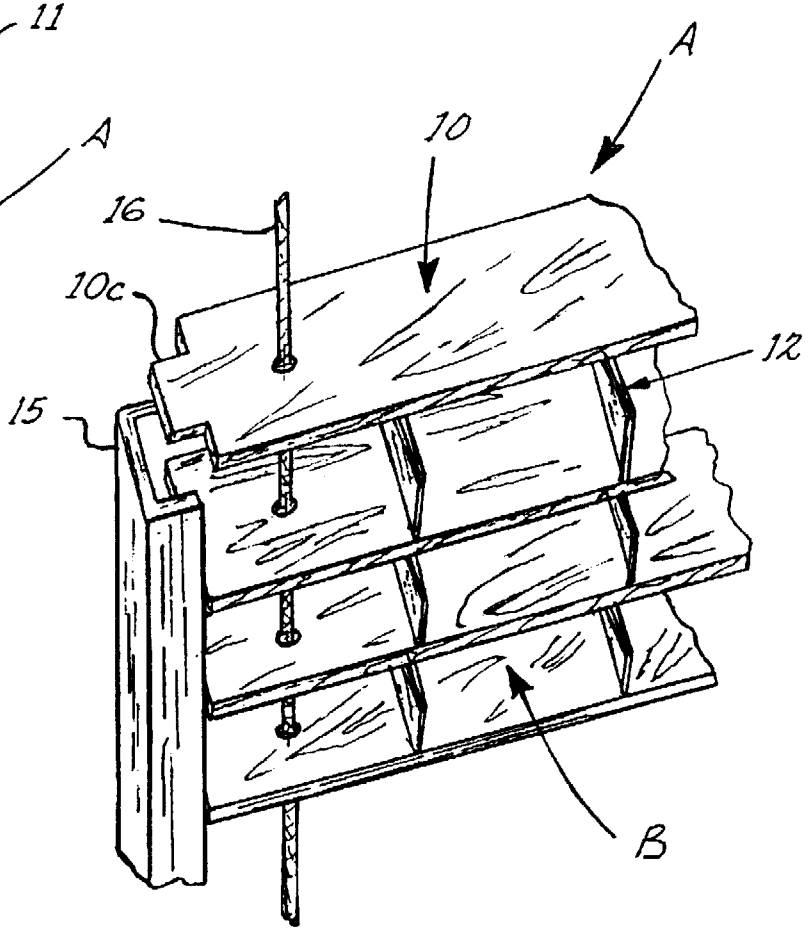
FIG. 3 is partial perspective view illustrating the sun blocking device according to the invention and side tracks for guiding the device as it is drawn upward and lowered downward.
Figure 4:
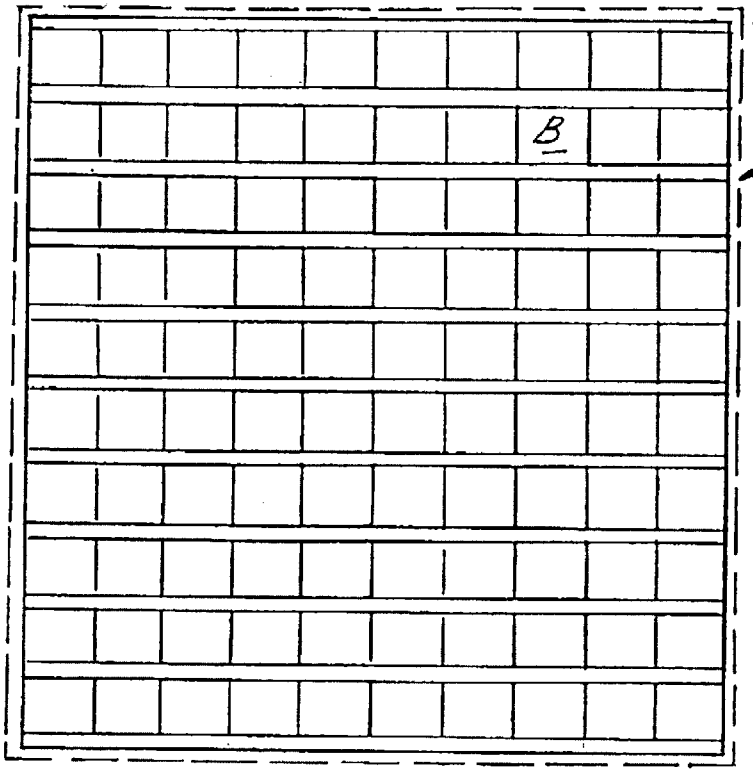
FIG. 4 is a front elevation of the sun blocking device constructed according to the present invention.
Figure 4A:
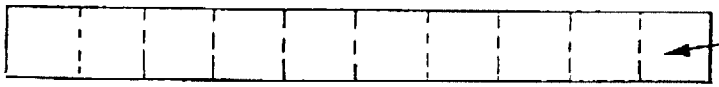
FIG. 4A is a top plan view of the sun blocking device of FIG. 4.

Since covering device A includes many contact points across the second dimension, as can best be seen in FIGS. 1 and 4, first strip elements 10 may be constructed from a width of fabric since the many points of connection with second strip elements 12 will hold the fabric strip in a generally level condition. In other words, because of the numerous points of attachment, first elements 10 do not necessarily need to be a stiffened or generally rigid element because the points of attachment will provide that result. However, in some applications a generally rigid strip may be preferred. Second strip elements 12 may be fabric or other suitable hinged materials which have a hinged line 14*a* for folding. In other embodiments of the invention, a folded construction may not be necessary as other suitable means for moving or removing the covering from the architectural opening may be utilized. In that case, covering A may be made as a rigid, nonfoldable member. It is also to be understood, of course, that instead of folding vertically, the covering may be provided in a orientation rotated 90° where the covering folds laterally. In an application where the covering is to be drawn vertically, any suitable draw mechanism actuated bydraw cord 16 may be utilized such as that shown in U.S. Pat. No. 5,386,867, which is incorporated here by reference, or any other conventional drawing mechanism. For raising and lowering of the covering, side track channels 15 and strip tongues 10*c* may be provided (FIG. 3). A tiltable mechanism may also be used for moving one or more of the strip elements to change the cell configuration from an open configuration for sun blocking and visibility to a closed configuration with reduced cell passage visibility.

Figure 7:
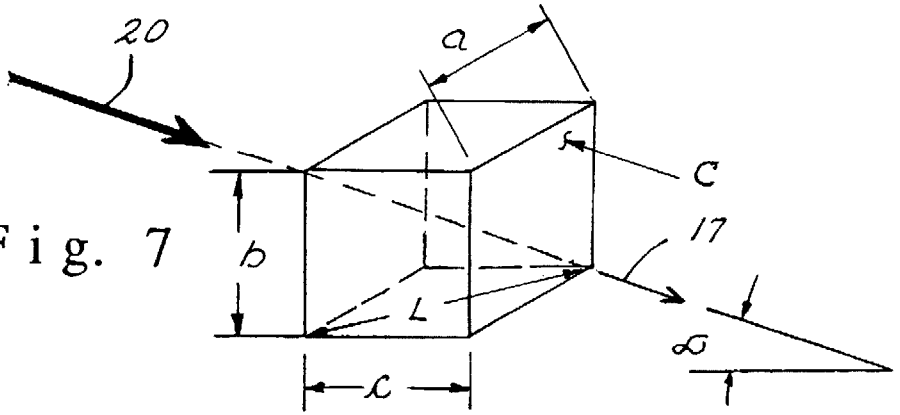
FIG. 7 is a perspective view illustrating the sun blocking geometry of a preferred embodiment of a sun blocking cell for use in the preferred embodiment of the present invention.
Figure 5:
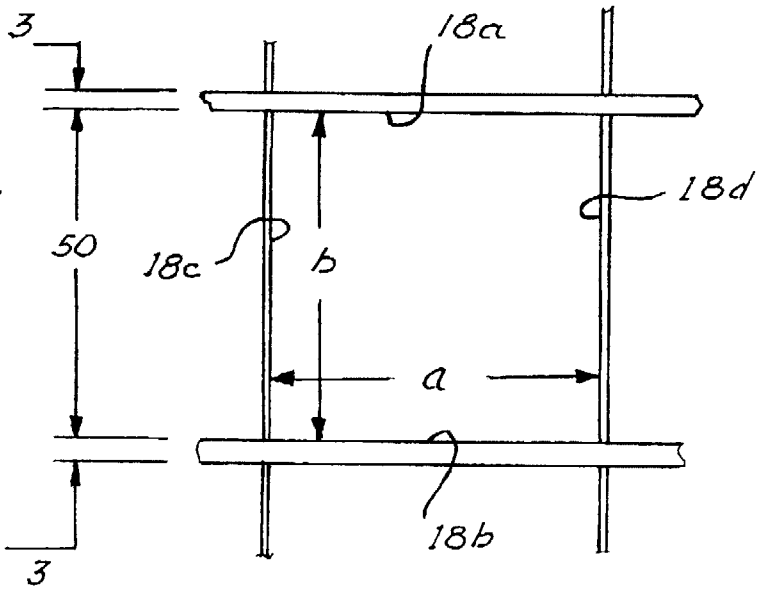
FIG. 5 is a front elevation of one of a plurality of sun blocking cells which are utilized in the construction of a preferred embodiment of a sun blocking device according to the invention.
Figure 6:
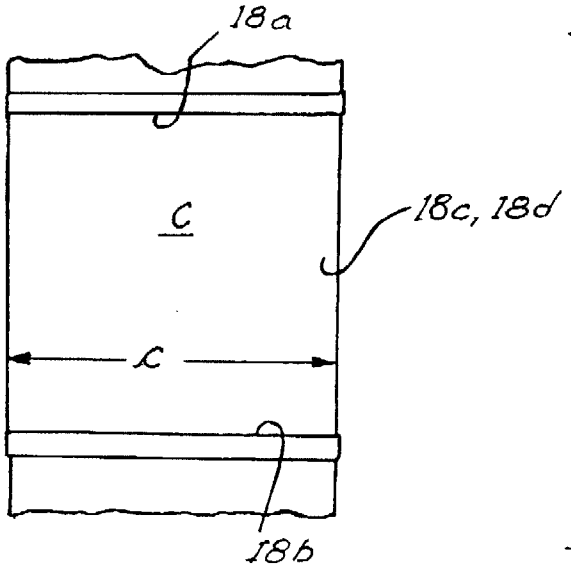
FIG. 6 is a side elevation of the sun blocking cell of FIG. 5.

Referring now in more detail to the invention, as can best be seen in FIGS. 5 through 7, sun blocking cells B includes an inner perimeter wall C which is closed and has a front opening and a rear opening defining a cell passage 17 which extends transverse to the architectural opening and provides a line of sight through the cell and visibility through the opening. In the illustrated embodiment, the inner perimeter wall is closed and is defined by a top wall 18 formed from upper strip 10*a*, and a bottom wall 18*b* formed from a top surface of a lower adjacent element 10*b*. The definition of the cell wall is completed by side walls 18*c* and 18*d* of next adjacent second strip elements 12*a* and 12*b* resulting in a rectangular configuration. Not only are solar rays and heat blocked coming in on a inclination which strikes the first elements 10, but a significant amount of side or diagonal entering solar rays are blocked which strikes the second elements 12. The sun blocking cells block a significant amount of solar rays and heat coming in at any inclination, that is any horizontal, vertical, and/or side or diagonal angle. While rectangular or square cells are illustrated it is to be understood that any cylindrical, oval, or polygonal configuration may be used as long a generally closed inner perimeter wall is provided having a major depth dimension compared to the cell height and width so that the bottom and side wall block substantial amounts of solar rays and heat while simultaneously providing a high degree of see through visibility outwardly and sunlight inwardly.

As can best be seen in FIGS. 5 through 7, in one illustrated embodiment of the invention, sidewalls 18*a* and 18*b* have a width "a" (FIG. 5), and a depth "c" (FIG. 6). Sidewalls 18*c* and 18*d* have a depth "c" (FIG. 6), and a height "b" (FIG. 5). As can best be seen in FIG. 7, the relationships of the sides of the sun blocking cell are illustrated which effectively block solar rays and heat to provide a substantial amount of sun blocking as sun rays 20 approach from the exterior, and provide a substantial amount of visibility from a building interior outwardly to the exterior, as well as a well illuminated interior. In the illustrated embodiment, the dimension "b" is equal to the dimension "c", i.e. the height of the cell is equal to the depth of the cell; and the dimension "a" is greater than or equal to the dimensions "b" and "c", i.e. the width of the cell is at least equal to the height and depth of the cell and may be greater so that the cell has a rectangular or square configuration.

Referring to FIGS. 8A–8C and 9A–9C, further aspects of the invention are illustrated. First, it will be noted that the exact performance of the invention will depend on the location of the architectural openings in relation to the sun during the seasons of the year. However, for purposes of illustration, the following examples will be referred to. As can best be seen, in FIGS. 8A–8C, a section of a sun-blocking shade according to the invention is illustrated wherein the sides of the sun blocking cell are equal, i.e. a=b=c. In this configuration, it can be seen in FIG. 8A that solar rays entering the shade at a vertical angle of 45° or more will be effectively blocked. As can best be seen in FIG. 8B, solar rays entering at a horizontal angle of 45° or greater will be blocked. As can best be seen in FIG. 8C, diagonal solar rays entering in at an included angle of greater than 35.3° will be blocked.

Referring now to FIGS. 9A through 9C, it can be seen at a section of a sun blocking shade according to the invention is illustrated wherein the depth "c" is equal to twice the height (b) and width (a). In this configuration, it can be seen in FIG. 9A that solar rays coming from the sun at a vertical angle greater than 29.5° will be effectively blocked. As can best be seen in FIG. 9B, it can be seen that solar rays entering at a horizontal angle of 29.5° or greater will be blocked. It can be seen from FIG. 9C that solar rays entering at a diagonal angle greater than an included angle of 32.3° will be blocked. Thus it can be seen that effective blocking of solar rays and heat can be had over a range of cell configurations. Accordingly, it is has been found that the depth of the sun blocking cells is important to achieving effective results. It is believed that depths in the range of one-half to twice (0.5–2.0) the height or width may be utilized for effective blocking with a preferable range of one to one and one-half (1.0–1.5) times the height or width, where the height or width are generally equal.

EXAMPLE

In one example of the invention, as can best be seen in FIGS. 5 through 7, first strip elements 10 have a thickness of 3.0 millimeters, and elements 12 have a thickness of 0.5 millimeters. These dimensions of "a", "b", and "c" are 50 millimeters. Accordingly, the width, height, depth of the sun blocking cells are equal. In that case, all sun rays entering the covering at a diagonal angle greater than or equal to 35.2° are blocked. In contrast, the covering has an open area of 93.4% for outward visibility. The open area can be calculated from the material dimension of the strip material forming the cells as a percentage of the total area.

Thus, it can be seen that an advantageous construction can be had for a window or door covering, and the like, wherein substantial sun light is block by the deep bottom and side wall(s) of an array of cells forming the covering which have see through cell passages providing a high degree of visibility through the covering and architectural opening. The thin construction of the thickness of the cell material provides a 90° or more opening of sight through the covering while the depth of the many cell perimeter walls block substantial sun rays and heat entering from any direction, i.e. omnidirectional sun ray blocking. Good ventilation is also provided if used with an open architectural opening.

While a preferred embodiment of the invention has been described using specific terms, such description is for illustrative purposes only, and it is to be understood that changes and variations may be made without departing from the spirit or scope of the following claims.

What is claimed is:

1. A device for covering an architectural opening to substantially block solar rays and heat while allowing substantial visibility outwardly through the opening comprising:

a covering substantially defining a plane, said covering having dimensions generally approximate that of said architectural opening;

said covering including a plurality of sun blocking cells arranged in a two-dimensional array having first and second dimensions, in said covering;

said sun blocking cells including an inner perimeter wall having a depth defined between front and rear openings by which said inner perimeter wall of said cells effectively blocks a substantial amount of said sun rays and heat;

said sun blocking cells having an open configuration for sun ray blocking and in which a cell passage is defined transverse to said architectural opening providing see through visibility through said opening, and said sun blocking cells having a closed configuration in which said visibility through said cell passage is reduced said covering including a plurality of first planar strip elements extending in the second dimension of said array, said first strip elements being spaced along said first dimension of said array, and a plurality of thin second strip elements extending between said first strip elements to define said sun blocking cells;

said first and second strip elements intersecting generally at a right angle to form a plurality of rectangular sun blocking cells extending in said first and second dimensions of said array;

said second strip elements including flexible web elements extending linearly between said first strip elements, and said flexible web elements being collapsible about at least one axis transverse to the plane of the covering so that said sun blocking cells assume said generally closed configuration when said covering is drawn together in a direction corresponding to said first dimension; and said foldable web elements having a width generally equal to said depth of said cell for effective sun blocking.

2. The device of claim 1 wherein said covering is drawable and has an undrawn position in which said covering generally coextends with said architectural opening and said sun blocking cells are in said open configuration, and said covering has a drawn configuration in which said sun blocking cells are in said closed configuration.

3. The device of claim 1 wherein said sun blocking cells have a height generally equal to said depth of said cells.

4. The device of claim 3 wherein said sun blocking cells have a width which is generally equal to or greater than said height and depth of said cells.

5. The device of claim 1 wherein said sun blocking cells have a generally square configuration with generally equal sides.

6. The device of claim 1 wherein said cells have a depth selected generally in a range of 0.5 to 2.0 of one of the dimensions of height and width.

7. The device of claim 6 wherein said cells have a depth selected generally in a range of 1.0 to 1.5 of one of the dimensions of height and width.

* * * * *